United States Patent [19]

Cea

[11] Patent Number: 4,546,944

[45] Date of Patent: Oct. 15, 1985

[54] POST CAP FOR MOUNTING FIXTURE

[75] Inventor: Michael S. Cea, Salem, N.H.

[73] Assignee: Keene Corporation, Union, N.J.

[21] Appl. No.: 570,917

[22] Filed: Jan. 16, 1984

[51] Int. Cl.[4] ..... F21V 21/10

[52] U.S. Cl. ..... 248/219.2; 248/231.2; 362/431; 403/297

[58] Field of Search ..... 362/382, 431, 403, 414; 403/217, 218, 297; 248/188, 219.2, 231.2

[56] References Cited

U.S. PATENT DOCUMENTS

| | | | |
|---|---|---|---|
| 2,687,547 | 8/1954 | Matter | 403/297 |
| 3,508,731 | 4/1970 | Jablonski | 362/431 |
| 4,064,432 | 12/1977 | Compton et al. | 362/431 |

*Primary Examiner*—William A. Cuchlinski, Jr.
*Attorney, Agent, or Firm*—Kane, Dalsimer, Kane, Sullivan and Kurucz

[57] ABSTRACT

A cap is provided for mounting a light fixture to a post having a longitudinal shaft of rectangular section extending therethrough. The cap includes a closure for the shaft bore having a drive cone secured to the closure and extending into the shaft interior. Fingers are mounted to the closure for transverse movement within the shaft. Each of the fingers has an inner edge abutting the cone and an outer edge adapted to engage the interior of the post when the finger is shifted outwardly. A drive screw extends through the closure and serves to drive the cone upwardly and hence the fingers outwardly.

8 Claims, 3 Drawing Figures

POST CAP FOR MOUNTING FIXTURE

BACKGROUND OF THE INVENTION

The present invention relates to light fixtures in general and in particular to an improved cap to facilitate the mounting of such fixtures to a rectangular post.

The conventional post-mounted fixture is secured to a fitter or cap which serves the double purpose of sealing the post bore and providing a mounting for the fixture. Heretofore it was customary to provide the cap with a central bore and to secure the fixture to a threaded stem extending through the bore. In some cases the central bore provides access to a locking cone which serves as a wedge to lock the post cap to the post.

The principle problem with such prior art caps stems from the fact that if the central stem or drive screw is loosened for any reason there is a danger that the fixture will spin off the post.

In view of the above, it is the principble object of the present invention to provide an improved post cap which may be locked to the post and remains locked regardless of any subsequent loosening of the central stem or drive screw.

A further object is to provide such a fixture which may readily be assembled and positioned.

A still further object is to provide such a cap which is aesthetically pleasing and which may readily be formed of conventional materials.

SUMMARY OF THE INVENTION

The above and other beneficial objections and advantages are attained in accordance with the present invention by providing a cap for mounting a fixture to a post having longitudinal shaft of rectangular section wherein the cap comprises a closure for the post. A drive cone is secured to the bottom of the closure and extends into the shaft interior. At least one finger is mounted to the cone for transverse movement within the shaft. The finger has an inner edge abutting the cone and an outer edge adapted to engage the interior of the post. A drive screw is provided to draw the cone upwardly to thereby drive the finger outwardly into engagement with the post. In a preferred embodiment of the invention four fingers are provided disposed along the diagonals of the post shaft. The outer edge of each of the fingers defines an angle of substantially 90° so as to enable the outer edges to engage and lock into the corners of the post shaft.

DETAILED DESCRIPTION OF THE PREFERRED EMBODIMENT.

Figure 1:
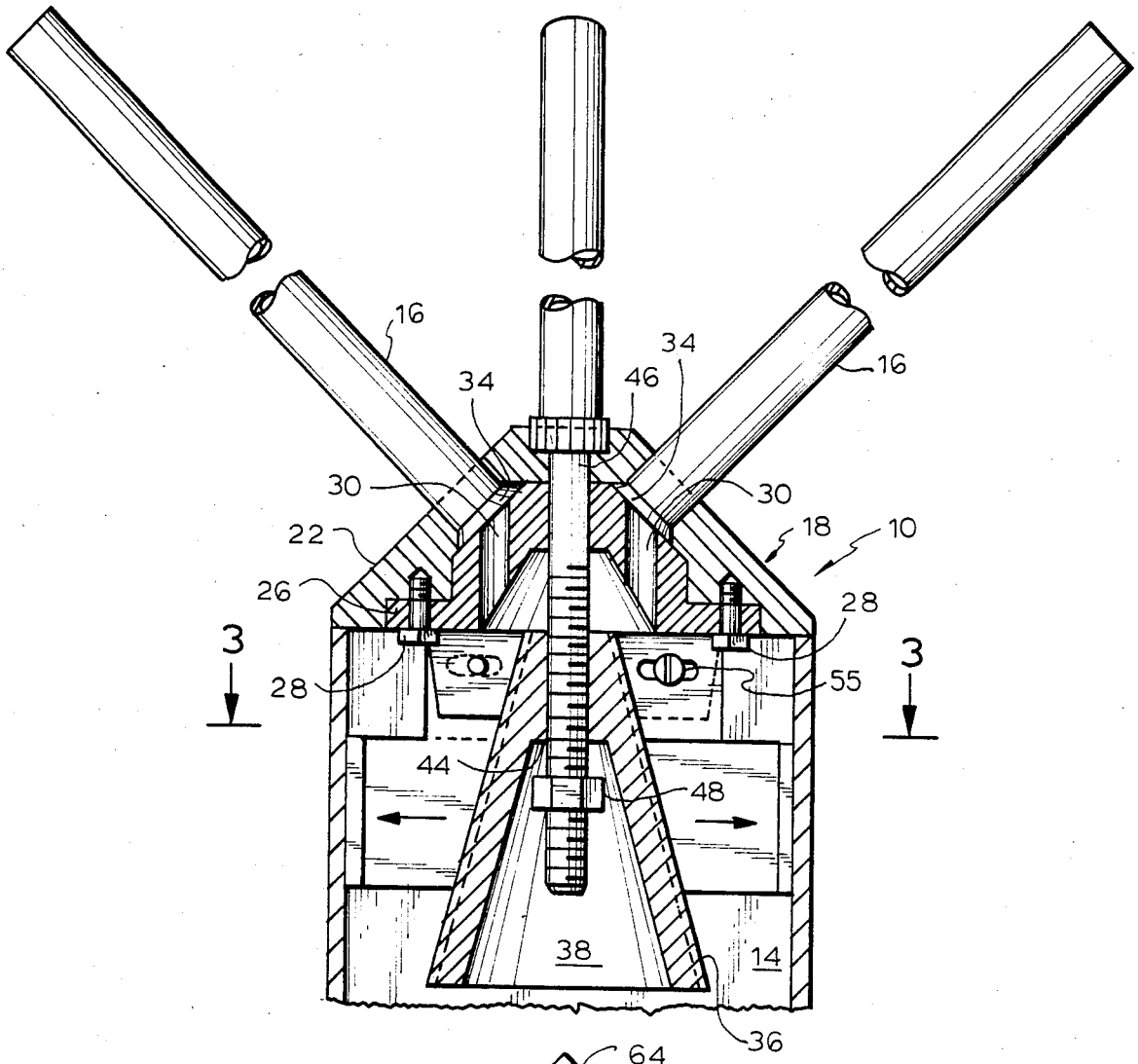
FIG. 1 is a fragmentary side elevational view of a post cap in accordance with the present invention in position on an associated post.
Figure 3:
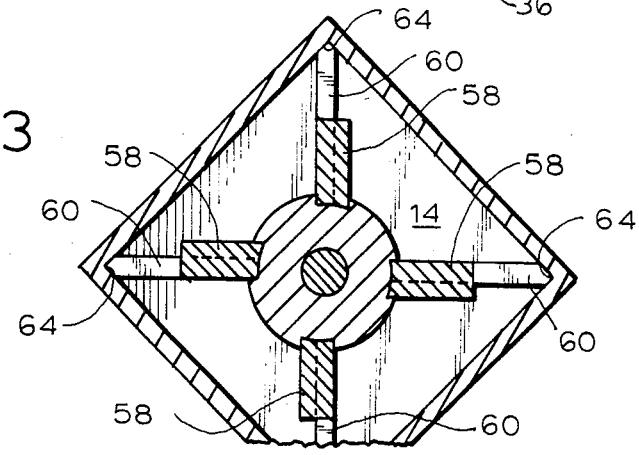

Reference is now made to the drawings and to FIG. 1 in particular wherein a post cap 10 in accordance with the present invention is shown positioned on top of a post 12. The post 12 has a rectangular shaft 14 extending therethrough which serves to carry electrical leads (not shown) to a fixture or series of fixtures which may be mounted to stems 16.

Figure 2:
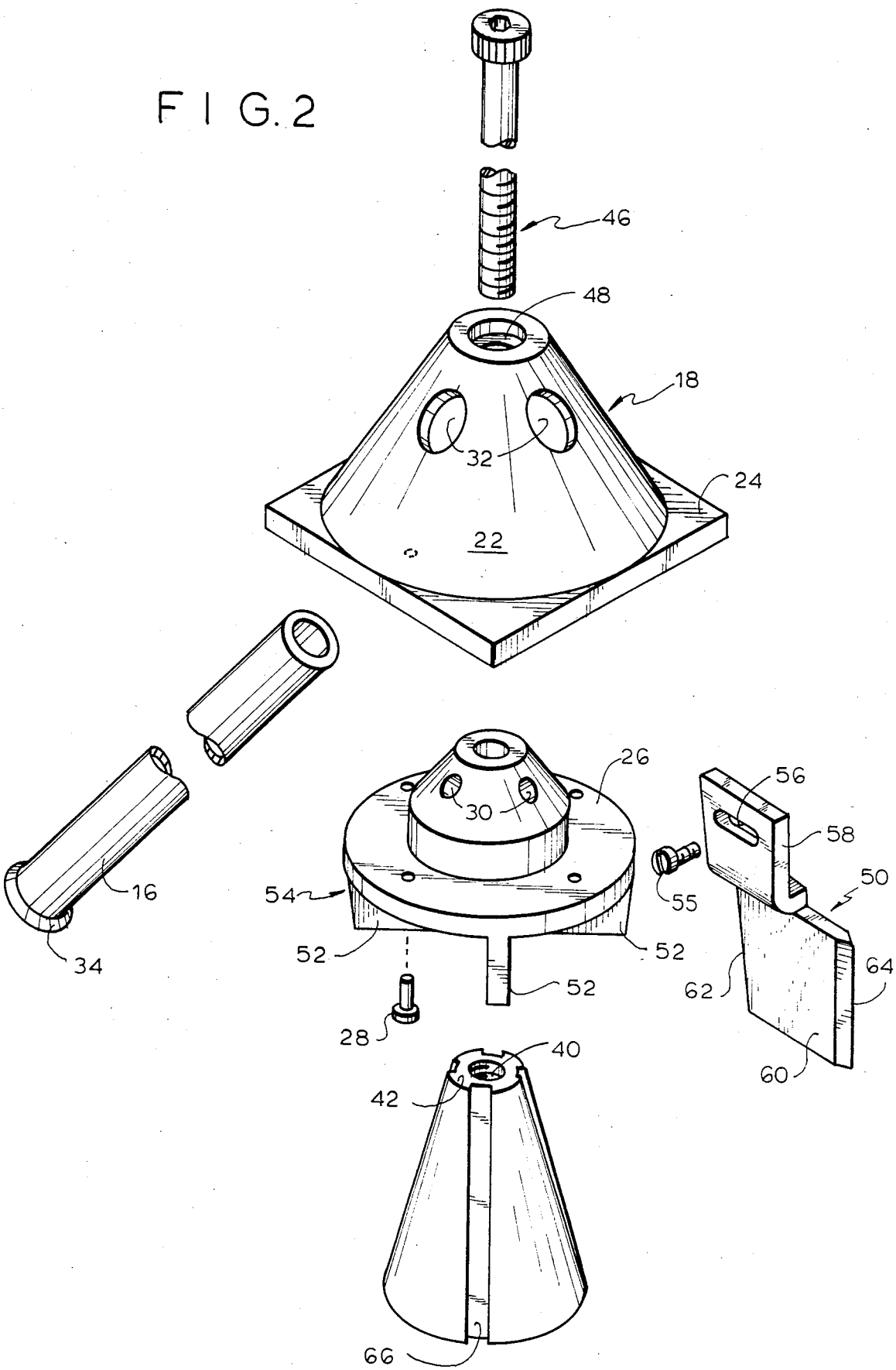
FIG. 2 is an exploded perspective view of the principle components of the present post cap; and, FIG. 3 is a fragmentary sectional view taken along reference lines 3—3 of FIG. 1 in the direction indicated by the arrows.

The cap 10 includes a closure 18 which serves to close the open top end of post 12. As shown in FIG. 2, closure 18 includes an outer member 20 comprising a cone 22 extending upwardly from a rectangular base 24. The peripheral edges of base 24 align with the outer periphery of post 12. An inner cone 26 fits into a recess in the outer cone 22 as shown in FIG. 1. A series of screws 28 serve to secure the inner cone 26 to the outer cone. A series of recesses 30 extend through the inner cone and align with recesses 32 in the outer cone. As shown in FIG. 1, the bottom of each recess 32 is countersunk to permit it to receive and secure the tapered base 34 of stem 16.

In accordance with the present invention, a drive cone 36 is disposed within the post secured to the underside of cap 10. A conical bore 38 extends upwardly from the bottom of drive cone 36. A bore 40 extends downwardly from the top surface 42 of cone 36. The conical bore 38 and bore 40 meet at shoulder 44. A drive screw 46 extends through an opening 48 that extends through both parts of the closure aligned with bore 40 of the drive cone. Drive screw 46 is engaged by nut 48 within the conical bore 38 of drive cone 36 and is dimensioned to seat against shoulder 44.

Four fingers 50 are provided secured to the arms 52 of a cross-shaped number 54 formed integral with the bottom of inner cone 26. Each of the fingers 50 is mounted to an arm 52 through a screw 55 passing through a transverse slot 56. As a result, the fingers 50 are transversely shiftable along a path defined by the slot. Slot 56 is formed on an offset 58 of finger 50. A lower portion 60 of finger 50 has an inner edge 62 to engage drive cone 36 and outer edge 64. Edge 64 is tapered at an angle of substantially 90° . A series of longitudinal tracks 66 extend along the outer periphery of drive cone 36 off set from each other by 90° . The inner edge of each of the fingers 50 is captured in one of the tracks as shown in FIG. 1.

In operation the cap 10 is fitted over a post 12 with the drive screw loosened as shown in FIG. 1. The fingers 50 are aligned with the diagonals of the post. After the electrical leads are drawn through stems 16 the drive screw 46 is tightened causing nut 46 to seat against shoulder 44 and eventually to move the drive cone 36 upwardly. As the drive cone 36 moves upwardly, fingers 50 are urged outwardly until their edges 64 engage the internal corners of the post shaft. These corners lock the fingers in position and prevent their rotation and hence the rotation of the cap. It should be noted that once the edges 64 of fingers 50 are captured within the internal corners of the post the cap will remain captured in position even if the drive screw 46 is subsequently loosened.

Thus, in accordance with the above, the aforementioned objects are effectively attained.

Having thus described the invention, what is claimed is:

1. A cap for mounting a fixture to a post having a longitudinal shaft extending therethrough, said cap comprising:

a closure for said shaft;

a drive cone secured to said closure and disposed below said closure and extending into said shaft interior said drive cone having a first longitudinal bore extending downwardly from the top end thereof and a second longitudinal bore extending upwardly from the bottom end thereof aligned with said first bore, said second bore having a larger diameter than said first bore whereby to define a shoulder;

at least one finger within said shaft mounted to said closure for transverse movement, said finger having an inner edge abutting said drive cone and an outer edge; and, means for shifting said drive cone upwardly with respect to said closure whereby said drive cone urges said finger outwardly to engage the interior of said post, said means including a drive screw extending through said closure; and a nut positioned within said drive cone second bore and dimensioned to seat against said shoulder.

2. The cap in accordance with claim 1 wherein said shaft has a rectangular cross-section and said finger is disposed along a diagonal of said shaft.

3. The cap in accordance with claim 2 wherein said finger outer edge is defined by an angle of substantially 90°.

4. The cap in accordance with claim 1 wherein said shaft has a rectangular cross-section, four fingers are mounted to said closure for transverse movement, each of said fingers being disposed along a diagonal of said shaft.

5. The cap in accordance with claim 4 wherein each of said fingers has an outer edge defined by an angle of substantially 90°.

6. The cap in accordance with claim 4 wherein said drive cone is disposed at the center of said closure.

7. The cap in accordance with claim 6 further comprising four tracks extending along said drive cone and the inner edge of each of said fingers is engaged in one of said tracks.

8. The cap in accordance with claim 1 wherein said closure comprises an outer member and an inner member secured to said outer member; a channel extending through said outer member; an inner member channel aligned with said outer member channel; and a stem extending through said outer member channel, said stem having a flared base captured between said inner and outer members.

* * * * *